US006915622B2

(12) United States Patent
Spatafora

(10) Patent No.: US 6,915,622 B2
(45) Date of Patent: Jul. 12, 2005

(54) METHOD FOR PACKING A PRODUCT USING A FLAT TUBULAR PACKAGE

(75) Inventor: Mario Spatafora, Bologna (IT)

(73) Assignee: G. D Societa' per Azioni, Bologna (IT)

( * ) Notice: Subject to any disclaimer, the term of this patent is extended or adjusted under 35 U.S.C. 154(b) by 0 days.

(21) Appl. No.: 10/457,801

(22) Filed: Jun. 9, 2003

(65) Prior Publication Data

US 2004/0168408 A1 Sep. 2, 2004

(30) Foreign Application Priority Data

Jun. 13, 2002 (IT) ..... BO2002A0379

(51) Int. Cl.[7] ..... B65B 43/30; B65B 5/06

(52) U.S. Cl. ..... 53/458; 53/468; 53/566; 53/381.1; 493/313

(58) Field of Search ..... 53/458, 566, 381.1, 53/492, 468; 493/313, 315, 316, 317

(56) References Cited

U.S. PATENT DOCUMENTS 5,562,581 A * 10/1996 Roberto et al. ..... 53/566

FOREIGN PATENT DOCUMENTS

| | | | | |
|---|---|---|---|---|
| DE | 2 250 667 | | 4/1974 | |
| EP | 0 734 948 | | 10/1996 | |
| FR | 2 532 912 | | 3/1984 | |
| JP | 07290608 | A * | 11/1995 | ..... B31B/1/76 |
| JP | 10324311 | A * | 12/1998 | ..... B65B/43/30 |
| JP | 2002120814 | A * | 4/2002 | ..... B65B/43/18 |

OTHER PUBLICATIONS

English Abstract of FR 2532912 Dated Mar. 16, 1984.

* cited by examiner

*Primary Examiner*—Stephen F. Gerrity
(74) *Attorney, Agent, or Firm*—Ladas & Parry

(57) ABSTRACT

A method and machine for packing a group of cartons of cigarettes using a flat tubular package, whereby a top wall of the flat tubular package is engaged by suction by a gripping head, which is then moved to feed the flat tubular package to a seat which engages a bottom wall of the flat tubular package by suction; a relative rotation movement is then produced between the seat and the gripping head to convert the tubular package from the flat configuration to an open configuration; the group of cartons of cigarettes is pushed inside the open tubular package; the gripping head releases the top wall of the open tubular package; and the seat is moved to feed the tubular package to a closing station where the tubular package is closed.

38 Claims, 5 Drawing Sheets

METHOD FOR PACKING A PRODUCT USING A FLAT TUBULAR PACKAGE

The present invention relates to a method of packing a product using a flat tubular package.

The present invention may be used to advantage on a machine for boxing cartons of cigarettes, i.e. a machine on which groups of cartons of cigarettes are packed in respective boxes, to which the following description refers purely by way of example.

BACKGROUND OF THE INVENTION

Currently known machines for boxing cartons of cigarettes comprise a unit for supplying and opening flat tubular packages, and which receives a stack of flat tubular packages off a pallet, and feeds each flat tubular package to a respective seat on a conveyor, by which the tubular package is fed along a straight packing path. Along the packing path, each tubular package remains connected to the respective seat, and is fed through an opening station, where the tubular package is opened into a configuration suitable for receiving a respective group of cartons of cigarettes; through an insertion station, where a respective group of cartons of cigarettes is pushed inside the open tubular package; and, finally, through a closing station, where the tubular package is closed by gumming and folding the relative flaps.

Known boxing machines of the type described above are fairly bulky, and require that the stack of flat tubular packages be located in a precise position for use on the boxing machine, thus calling for periodic assistance on the part of the operator.

SUMMARY OF THE INVENTION

It is an object of the present invention to provide a method of packing a product using a flat tubular package, designed to eliminate the aforementioned drawbacks, and which, in particular, is cheap and easy to implement.

According to the present invention, there is provided a method of packing a product using a flat tubular package, which comprises a top wall, a bottom wall, and two lateral walls, each connected on one side to the top wall and on the other side to the bottom wall; the method being characterized by comprising the steps of: engaging the top wall of the flat tubular package by suction using a gripping head; moving the gripping head to feed the flat tubular package to a seat engaging the bottom wall of the flat tubular package by suction; producing a relative rotation movement between the seat and the gripping head to convert the tubular package from the flat configuration to an open configuration; and inserting the product inside the open tubular package.

The present invention also relates to a machine for packing a product using a flat tubular package.

According to the present invention, there is provided a machine for packing a product using a flat tubular package, which comprises a top wall, a bottom wall, and two lateral walls, each connected on one side to the top wall and on the other side to the bottom wall; the machine being characterized by comprising a suction gripping head for engaging the top wall of the flat tubular package; a suction seat for engaging the bottom wall of the flat tubular package; a feed device supporting the gripping head, and for moving the gripping head to feed the flat tubular package to the suction seat, and for producing a relative rotation movement between the suction seat and the gripping head to convert the tubular package from the flat configuration to an open configuration; and an insertion device for inserting the product inside the open tubular package.

BRIEF DESCRIPTION OF THE DRAWINGS

A non-limiting embodiment of the present invention will be described by way of example with reference to the accompanying drawings, in which.

DETAILED DESCRIPTION OF THE INVENTION

Figure 1:
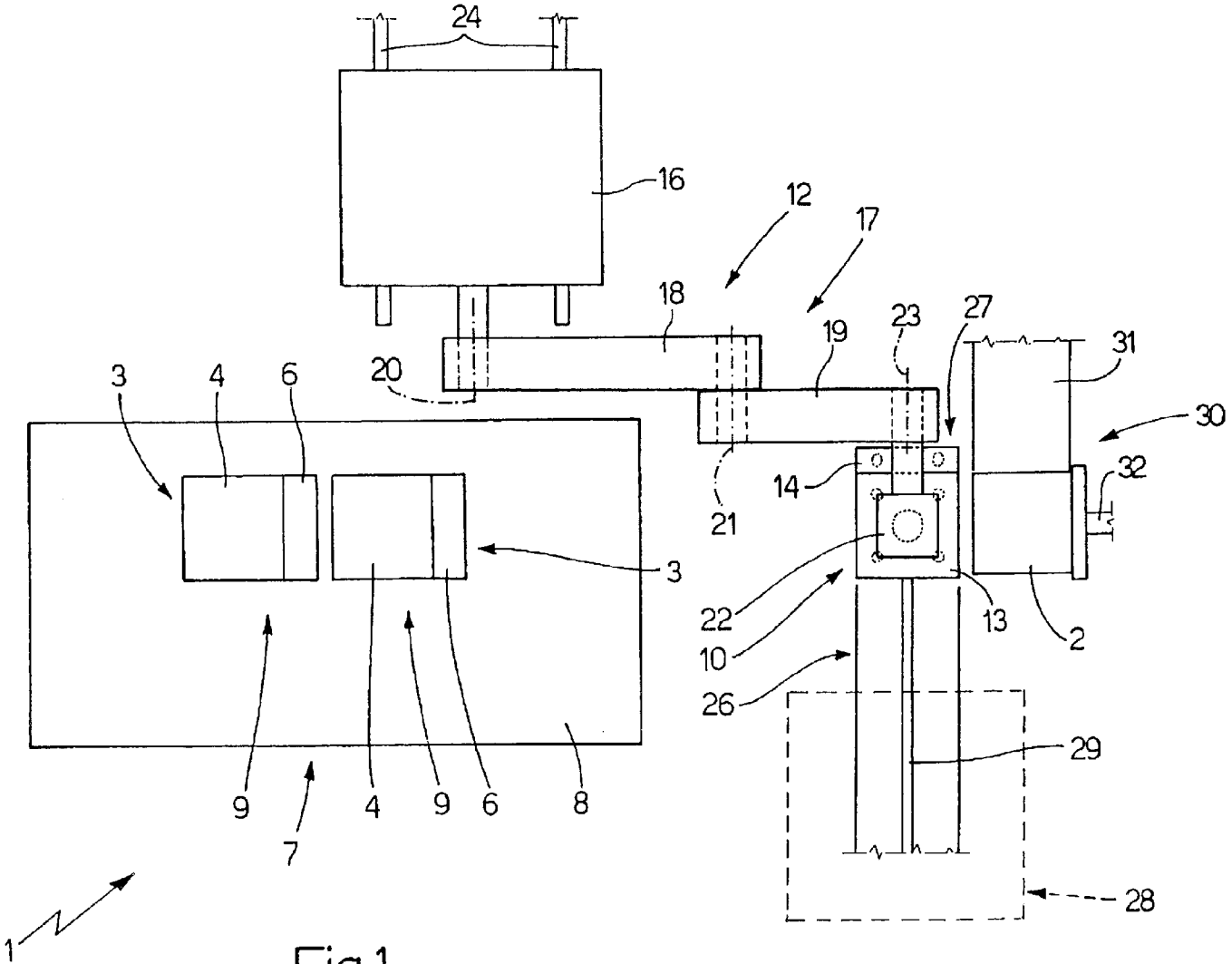
FIG. 1 shows a schematic plan view of a boxing machine, in accordance with the present invention, for boxing cartons of cigarettes.

Number 1 in FIG. 1 indicates as a whole a boxing machine for boxing groups 2 of cartons of cigarettes; which machine 1 provides for inserting each group 2 of cartons of cigarettes into a respective tubular package 3 comprising a top wall 4, a bottom wall 5, and two lateral walls 6, each connected on one side to top wall 4 and on the other side to bottom wall 5 (as shown in FIGS. 5–8).

Boxing machine 1 comprises an input station 7, which houses a pallet 8 supporting two stacks 9 of flat tubular packages 3, i.e. tubular packages 3 pressed into a flat configuration; and each flat tubular package 3 in each stack 9 lies in a horizontal plane.

Boxing machine 1 also comprises a suction gripping head 10 for engaging top wall 4 of the top flat tubular package 3 in one of stacks 9; a suction seat 11 for engaging bottom wall 5 of tubular package 3; and a feed device 12 supporting gripping head 10, and for moving gripping head 10 to feed flat tubular package 3 to seat 11.

More specifically, suction gripping head 10 comprises a suction portion 13 for engaging top wall 4 of a tubular package 3; and a suction portion 14 for engaging a lateral wall 6 of a tubular package 3.

Figure 2:
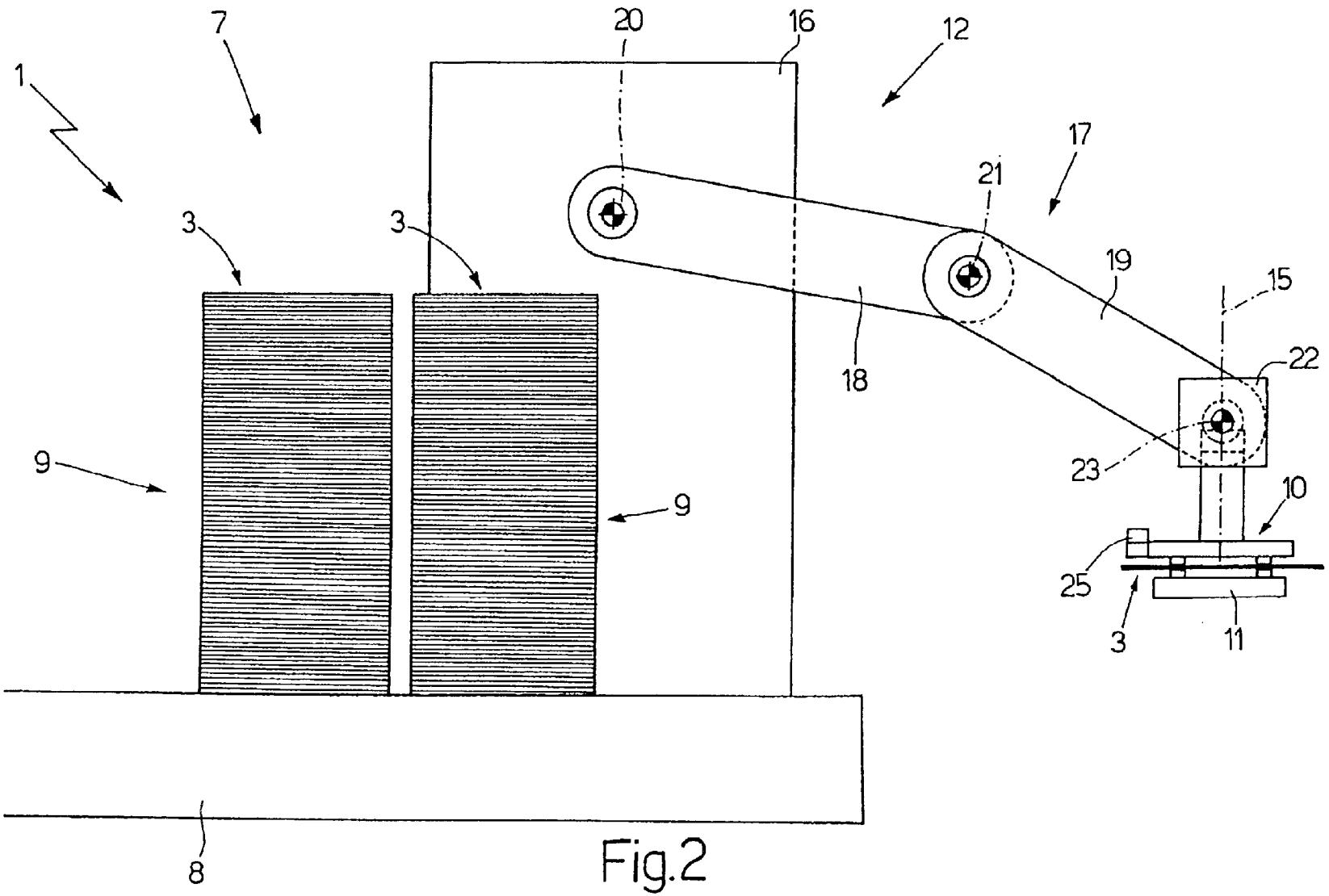
FIG. 2 shows a front view of a feed device in FIG. 1.
Figure 3:
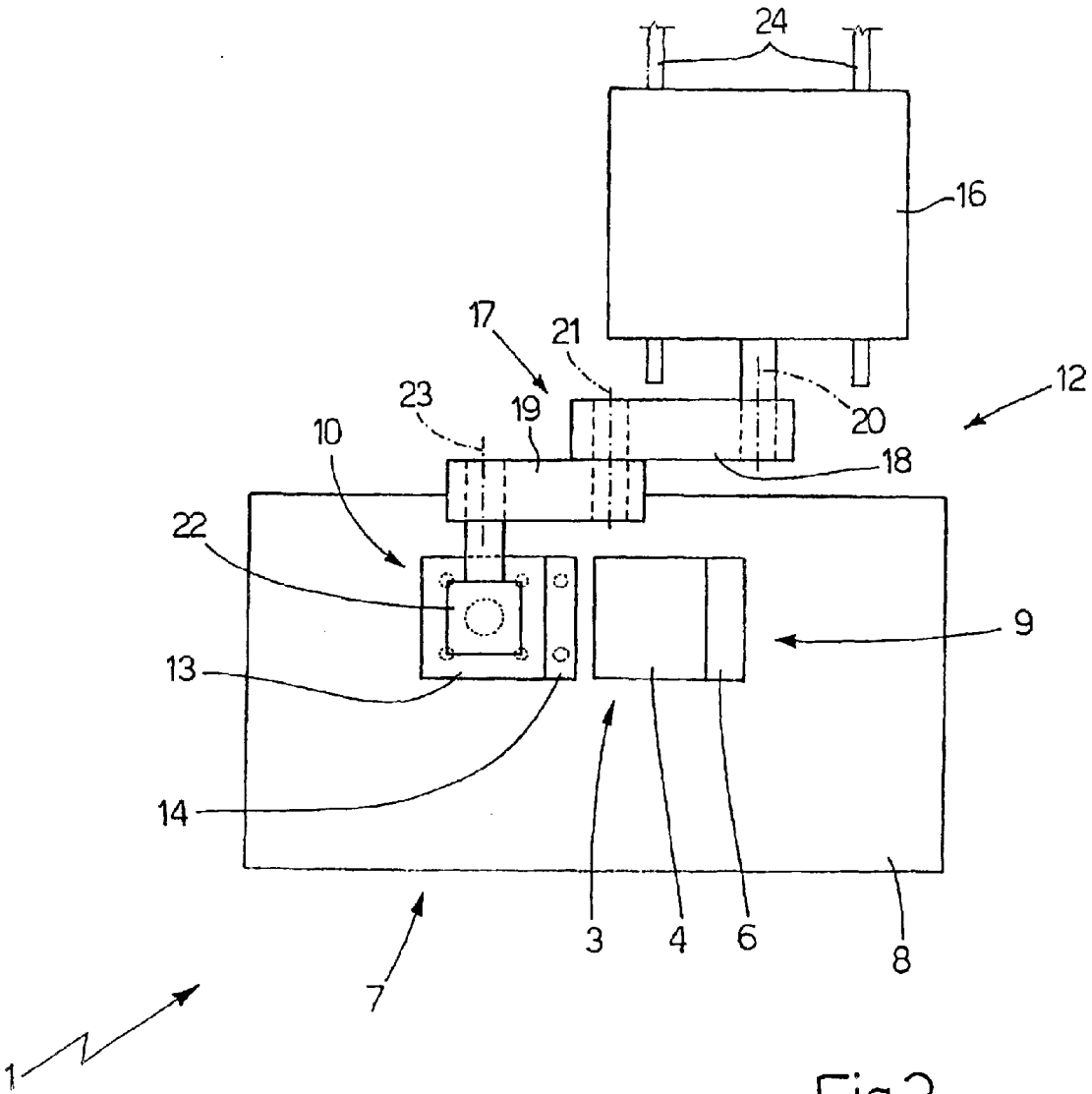
FIG. 3 shows a schematic plan view of the FIG. 1 boxing machine in a different operating configuration.
Figure 4:
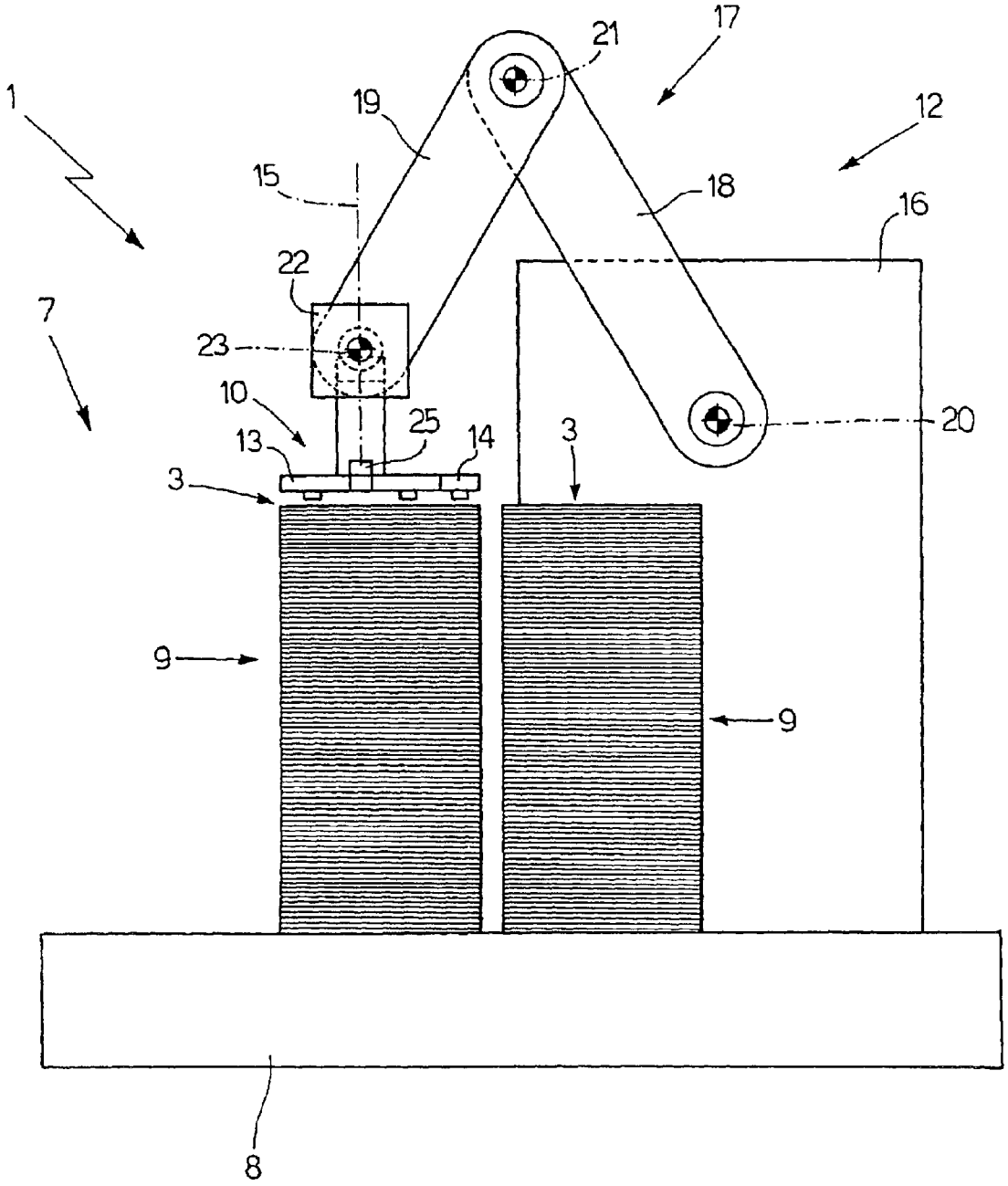
FIG. 4 shows a front view of the FIG. 2 feed device in a different operating configuration.

As shown in FIGS. 1 and 2, feed device 12 moves gripping head 10 with four degrees of freedom comprising three translations in three directions perpendicular to one another, and one rotation about a vertical axis 15 perpendicular to the horizontal plane of flat tubular package 3. More specifically, feed device 12 comprises a base 16 supporting a powered articulated arm 17 in turn comprising two members 18 and 19 hinged to each other; member 18 is hinged at one end to base 16 to rotate, with respect to base 16, about a horizontal axis 20, and is hinged at the opposite end to member 19 to rotate, with respect to member 19, about a horizontal axis 21 parallel to axis 20; member 19 is hinged at one end to member 18 to rotate, with respect to member 18, about horizontal axis 21, and is hinged at the opposite end to a powered articulated joint 22 to rotate, with respect to articulated joint 22, about a horizontal axis 23 parallel to axes 20 and 21; and articulated joint 22 is hinged, on one side, to member 19 to rotate, with respect to member 19, about axis 23, and is hinged, on the opposite side, to suction gripping head 10 to rotate suction gripping head 10 about vertical axis 15 perpendicular to axes 20, 21 and 23.

Articulated arm 17 is powered to keep suction gripping head 10 horizontal at all times and therefore parallel to the plane of flat tubular packages 3; the movement of articulated arm 17 moves suction gripping head 10 parallel to itself in a vertical plane perpendicular to axes 20, 21 and 23; and base 16 is run, by a respective known motor (not shown), along a horizontal guide 24 parallel to axes 20, 21 and 23 to move suction gripping head 10 in a direction parallel to axes 20, 21 and 23.

Suction gripping head 10 comprises a known optical sensor 25 for determining the exact position of the top flat tubular package 3 in stack 9, before flat tubular package 3 is engaged; and a known control unit (not shown) is provided to control feed device 12 supporting suction gripping head 10, so as to adapt the position of suction gripping head 10 to the exact detected position of flat tubular package 3, and engage flat tubular package 3 in accordance with a predetermined mutual arrangement, so that feed device 12 operates correctly even in the event flat tubular packages 3 are not positioned correctly in stacks 9.

As shown in FIG. 1, suction seat 11 is supported by a linear conveyor 26 for moving seat 11 between a receiving station 27 for receiving a tubular package 3 (as shown in FIG. 1), and a transfer position (not shown) wherein seat 11 is located close to a known closing station 28 (shown schematically in FIG. 1) where a known transfer device (not shown) is provided to transfer an open tubular package 3 containing the group of cartons of cigarettes from suction seat 11 to closing station 28. More specifically, linear conveyor 26 comprises a fixed guide 29 along which suction seat 11 runs; and a known reversible motor (not shown) for moving suction seat 11 along fixed guide 29.

In a different embodiment not shown, conveyor 26 comprises an endless moving belt supporting and for moving a number of suction seats 11 cyclically along an endless path through receiving station 27 and closing station 28.

In a further embodiment not shown, suction seat 11 is mounted in a fixed position at receiving station 27, and a push device is provided to transfer an open tubular package 3 containing a respective group 2 of cartons of cigarettes from suction seat 11 to closing station 28.

Finally, boxing machine 1 comprises an insertion device 30 located close to receiving station 27 and for inserting a group 2 of cartons of cigarettes into an open tubular package 3 located at receiving station 27 and supported by suction seat 11. Insertion device 30 comprises a conveyor 31 for feeding groups 2 of cartons of cigarettes successively into alignment with respect to the open tubular package 3 at receiving station 27; and a pusher 32 for pushing group 2 of cartons of cigarettes into open tubular package 3.

Operation of boxing machine 1 will now be described with reference to a flat tubular package 3 on top of a stack 9, and to a respective group 2 of cartons of cigarettes.

Firstly, feed device 12 moves suction head 10 to engage flat tubular package 3, so that portion 13 of suction head 10 engages top wall 4 of flat tubular package 3, and suction portion 14 of suction head 10 engages lateral wall 6 of flat tubular package 3. More specifically, feed device 12 moves suction head 10 over to the estimated (i.e. best-condition) position of flat tubular package 3; by means of optical sensor 25, suction gripping head 10 then determines the real position of flat tubular package 3; and, on the basis of the real position of flat tubular package 3, feed device 12 is operated to adapt the position of suction gripping head 10 to the real position of flat tubular package 3, and so enable gripping head 10 to engage flat tubular package 3 in accordance with a given mutual arrangement.

Feed device 12 then moves suction gripping head 10, together with flat tubular package 3, over to receiving station 27 to feed flat tubular package 3 to suction seat 11, which engages the bottom wall 5 of flat tubular package 3; at which stage, flat tubular package 3 is engaged simultaneously by suction head 10 and suction seat 11. As it is being transferred to receiving station 27, suction gripping head 10 is rotated 90° about vertical axis 15 to similarly rotate flat tubular package 3 into the correct position for supply to suction seat 11.

A relative rotation movement is then produced between suction seat 11 and gripping head 10 to convert tubular package 3 from the flat configuration to an open configuration. More specifically, the relative rotation movement is preferably produced by keeping suction seat 11 stationary and moving gripping head 10. Alternatively, the relative rotation movement may be produced by moving suction seat 11 horizontally and gripping head 10 vertically.

Figure 5:
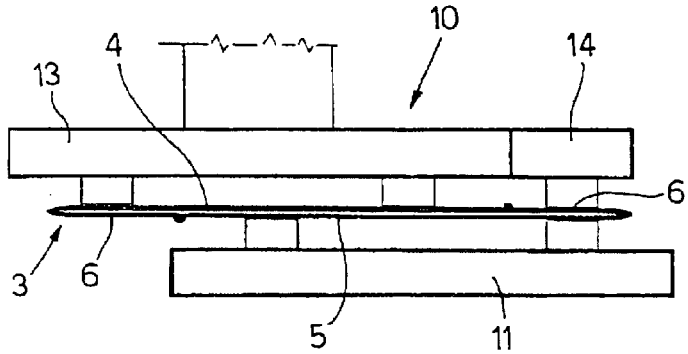
FIGS. 5, 6 and 7 show, schematically, an operating sequence of the FIG. 1 boxing machine.
Figure 6:
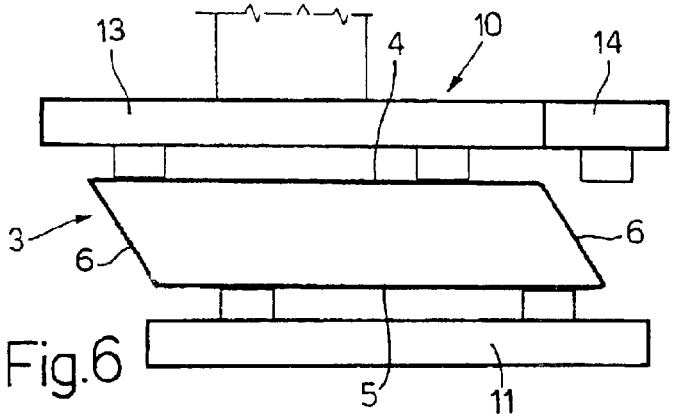
Figure 8:
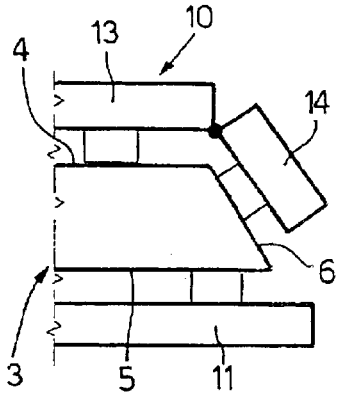
FIG. 8 shows a different embodiment of a detail in FIG. 6.
Figure 7:
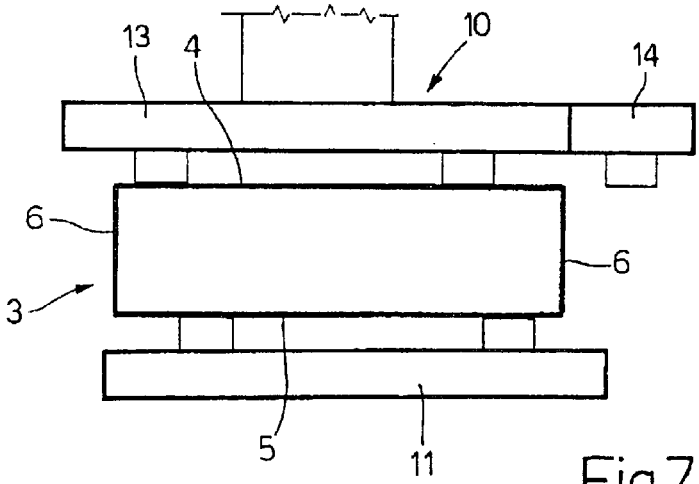

The relative rotation movement between suction seat 11 and gripping head 10 is shown in FIGS. 5, 6 and 7, which show clearly how suction portion 14 of gripping head 10 releases lateral wall 6 of flat tubular package 3 before the relative rotation movement is produced, so as to enable lateral wall 6 to rotate with respect to top wall 4 and bottom wall 5. In an alternative embodiment shown in FIG. 8, suction portion 14 is hinged to suction portion 13, and suction gripping head 10 comprises a known actuator (not shown) for keeping suction portion 14 parallel to suction portion 13 up to the step of producing a relative rotation movement between seat 11 and gripping head 10, and for rotating second suction portion 14 with respect to first suction portion 13, so as to accompany the rotation of lateral wall 6 to convert tubular package 3 from the flat configuration to the open configuration.

Once tubular package 3 is in the open configuration, insertion device 30 inserts group 2 of cartons of cigarettes inside the open tubular package 3; gripping head 10 then releases top wall 4 of the open tubular package 3; seat 11 is moved to feed package 3 to closing station 28; the open tubular package 3 containing group 2 of cartons of cigarettes is transferred from seat 11 to the closing station; and seat 11 is then returned to receiving station 27 to receive another flat tubular package 3 from suction head 10.

Boxing machine 1 as described above has countless advantages, by being relatively straightforward and compact, and by not requiring a precise position of tubular packages 3 in stacks 9, which can therefore be supplied fully automatically.

What is claimed:

1. A method of packing a product using a flat tubular package, which comprises a top wall (4), a bottom wall (5), and two lateral walls (6), each connected on one side to the top wall (4) and on the other side to the bottom wall (5); the method comprising the steps of:

engaging the top wall (4) of the flat tubular package (3) by suction using a gripping head (10); moving the gripping head (10) to feed the flat tubular package (3) to a seat (11) engaging the bottom wall (5) of the flat tubular package (3) by suction;

producing a relative rotation movement between the seat (11) and the gripping head (10) to convert the tubular package (3) from the flat configuration to an open configuration; and inserting the product (2) inside the open tubular package (3)

wherein the gripping head (10) engages by suction both the top wall (4) and a lateral wall (6) of the flat tubular package (3); and the gripping head (10) releases the lateral wall (6) of the flat tubular package (3) prior to the step of producing a relative rotation movement between the seat (11) and the gripping head (10) to convert the tubular package (3) from the flat configuration to the open configuration.

2. A method as claimed in claim 1, wherein, following the step of inserting the product (2) inside the open tubular package (3), the gripping head (10) releases the top wall (4) of the open tubular package (3), and the seat (11) is moved to feed the package (3) to a closing station (28).

3. A method as claimed in claim 2, wherein the open tubular package (3) containing the product (2) is transferred from the seat (11) to the closing station (28), and the seat (11) is then returned to the initial position to receive another flat tubular package (3).

4. A method as claimed in claim 1, wherein, following the step of inserting the product (2) inside the open tubular package (3), the gripping head (10) releases the top wall (4) of the open tubular package (3), and the seat (11) is moved to feed the package (3) through a closing station (28).

5. A method as claimed in claim 1, wherein, following the step of inserting the product (2) inside the open tubular package (3), the gripping head (10) and the seat (11) release the open tubular package (3), and the open tubular package (3) is transferred to a closing station (28).

6. A method as claimed in claim 1, wherein the flat tubular package (3) is removed by the gripping head (10) off a stack (9) of flat tubular packages (3).

7. A method as claimed in claim 6, wherein, during the step of moving the gripping head (10) to feed the flat tubular package (3) to the seat (11), the flat tubular package (3) is rotated 90° about an axis (15) perpendicular to the plane of the flat tubular package (3).

8. A method as claimed in claim 6, wherein, before engaging the flat tubular package (3) on top of the stack (9), the gripping bead (10) determines the exact position of the flat tubular package (3), and adapts its own position accordingly, so as to engage the flat tubular package (3) in accordance with a predetermined mutual arrangement.

9. A method as claimed in claim 8, wherein the gripping head (10) is moved with four degrees of freedom comprising three translations in three directions perpendicular to one another, and one rotation about an axis (15) perpendicular to the plane of the flat tubular package (3).

10. A method as claimed in claim 1, wherein the gripping head (10) comprises a first suction portion (13) for engaging the top wall (4), and a second suction portion (14) hinged to the first suction portion (13) and for engaging the lateral wall (6); the gripping head (10) engaging by suction both the top wall (4) and a lateral wall (6) of the flat tubular package (3); the second suction portion (14) being kept parallel to the first suction portion (13) up to the step of producing a relative rotation movement between the seat (11) and the gripping head (10) to convert the tubular package (3) from the flat configuration to the open configuration; and the second suction portion (14) being rotated with respect to the first suction portion (13) to accompany the movement of the lateral wall (6) during the step of producing a relative rotation movement between the seat (11) and the gripping head (10) to convert the tubular package (3) from the flat configuration to the open configuration.

11. A method as claimed in claim 1, wherein the product (2) is defined by a group (2) of cartons of cigarettes.

12. A method as claimed in claim 1, wherein the method is performed in a packing machine comprising the suction gripping head (10) for engaging the top wall (4) of the flat tubular package (3);

the suction seat (11) for engaging the bottom wall (5) of the flat tubular package (3);

a feed device (12) supporting the gripping head (10), for moving the gripping head (10) to feed the flat tubular package (3) to the suction seat (11), and for producing the relative rotation movement between the suction seat (11) and the gripping head (10) to convert the tubular package (3) from the flat configuration to the open configuration; and an insertion device (30) for inserting the product (2) inside the open tubular package (3).

13. A method as claimed in claim 12, wherein the packing machine is provided with a closing station (28); the method further comprising the step of moving the suction seat (11) by a conveyor (26) to feed the tubular package (3) to the closing station (28) following insertion of the product (2) inside the open tubular package (3).

14. A method as claimed in claim 13, further comprising transferring the open tubular package (3) containing the product (2) from the suction seat (11) to the closing station (28).

15. A method as claimed in claim 13, wherein the suction seat (11) runs along a fixed guide of the conveyor (26) the method comprising the step of moving the suction seat (11) along the fixed guide by a reversible motor.

16. A method as claimed in claim 12, wherein the packing machine has a closing station (28); the method further comprising the step of moving the suction seat (11) to feed the open tubular package (3) containing the product (2) through the closing station (28).

17. A method as claimed in claim 12, wherein the packing machine has a closing station (28); the method further comprising the step of transferring by a push device the open tubular package (3) containing the product (2) from the suction seat (11) to the closing station (28); and fitting the suction seat (11) to the machine (1) in a fixed position.

18. A method as claimed in claim 12, wherein the packing machine has an input station (7) housing at least one stack (9) in said input station, the method further comprising the step of gradually engaging the tubular packages by the gripping head (10).

19. A method as claimed in claim 18, further comprising the steps of determining the exact position of the flat tubular package (3) on top of the stack (9), before the flat tubular package (3) is engaged; and controlling the feed device (12) supporting the gripping head (10), so as to adapt the position of the gripping head (10) as a function of the exact position determined of the flat tubular package (3), and engage the flat tubular package (3) in accordance with a predetermined mutual arrangement.

20. A method as claimed in claim 19, further comprising moving the gripping head (10) with four degrees of freedom comprising three translations in three directions perpendicular to one another, and one rotation about an axis (15) perpendicular to the plane of the flat tubular package (3).

21. A method as claimed in claim 18, wherein the plane of the flat tubular package (3) is a substantially horizontal plane; the feed device (12) having a base (16) supporting a powered articulated arm comprising two members hinged to each other; a first member (18) being hinged at one end to the base (16) rotating with respect to the base (16) about a horizontal first axis (20), and being hinged at the opposite end to the second member (19) for rotating with respect to the second member (19) about a horizontal second axis (21); the second member (19) being hinged at one end to the first member (18) for rotating with respect to the first member (18) about the horizontal second axis (21), and being hinged at the opposite end to the gripping head (10) for rotating with respect to the gripping head (10) about a horizontal third axis (23).

22. A method as claimed in claim 21, further comprising interposing a powered articulated joint (22) between the second member (19) and hinging the gripping head (10), on one side, to the second member (19), and, on the opposite side, to the gripping head (10) to rotate the gripping head (10) about a vertical axis (15).

23. A method as claimed in claim 21, further comprising mounting the base (16) of the feed device (12) to run, by virtue of a respective motor, along a horizontal guide (24) parallel to the horizontal first, second and third axes (20, 21, 23).

24. A method as claimed in claim 12, wherein the gripping head (10) comprises a first suction portion (13) for engaging the top wall (4), and a second suction portion (14) for engaging the lateral wall (6); and controlling the suction through the first suction portion (13) independently with respect to suction through the second suction portion (14).

25. A method as claimed in claim 12, wherein the gripping head (10) has a first suction portion (13) for engaging the top wall (4), and a second suction portion (14) hinged to the first suction portion (13) and for engaging the lateral wall (6); the gripping head (10) having an actuator for keeping the second suction portion (14) parallel to the first suction portion (13) up to the step of producing a relative rotation movement between the suction seat (11) and the gripping head (10) to convert the tubular package (3) from the flat configuration to the open configuration, and for rotating the second suction portion (14) with respect to the first suction portion (13) to accompany the movement of the lateral wall (6) during the step of producing a relative rotation movement between the suction seat (11) and the gripping head (10) to convert the tubular package (3) from the flat configuration to the open configuration.

26. A method as claimed in claim 12, comprising feeding the product (2) into aligmnent with respect to the open tubular package (3) by a conveyor of the insertion device; and pushing the product (2) into the open tubular package (3).

27. A method of packing a product using a flat tubular package, which comprises a top wall (4), a bottom wall (5), and two lateral walls (6), each connected on one side to the top wall (4) and on the other side to the bottom wall (5); the method comprising the steps of:

engaging the top wall (4) of the flat tubular package (3) by suction using a gripping head (10); moving the gripping head (10) to feed the flat tubular package (3) to a seat (11) engaging the bottom wall (5) of the flat tubular package (3) by suction;

producing a relative rotation movement between the seat (11) and the gripping head (10) to convert the tubular package (3) from the flat configuration to an open configuration; and inserting the product (2) inside the open tubular package (3);

wherein the flat tubular package (3) is removed by the gripping head (10) off a stack (9) of flat tubular packages (3); and wherein, during the step of moving the gripping head (10) to feed the flat tubular package (3) to the seat (11), the flat tubular package (3) is rotated 90° about an axis (15) perpendicular to the plane of the flat tubular package (3).

28. A method of packing a product using a flat tubular package, which comprises a top wall (4), a bottom wall (5), and two lateral walls (6), each connected on one side to the top wall (4) and on the other side to the bottom wall (5); the method comprising the steps of:

engaging the top wall (4) of the flat tubular package (3) by suction using a gripping head (10); moving the gripping head (10) to feed the flat tubular package (3) to a seat (11) engaging the bottom wall (5) of the flat tubular package (3) by suction;

producing a relative rotation movement between the seat (11) and the gripping head (10) to convert the tubular package (3) from the flat configuration to an open configuration; and inserting the product (2) inside the open tubular package (3);

wherein the flat tubular package (3) is removed by the gripping head (10) off a stack (9) of flat tubular packages (3), and wherein, before engaging the flat tubular package (3) on top of the stack (9), the gripping head (10) determines the exact position of the flat tubular package (3), and adapts its own position accordingly, so as to engage the flat tubular package (3) in accordance with a predetermined mutual arrangement.

29. A method as claimed in claim 28, wherein the gripping head (10) is moved with four degrees of freedom comprising three translations in three directions perpendicular to one another, and one rotation about an axis (15) perpendicular to the plane of the flat tubular package (3).

30. A method of packing a product using a flat tubular package, which comprises a top wall (4), a bottom wall (5), and two lateral walls (6), each connected on one side to the top wall (4) and on the other side to the bottom wall (5); the method comprising the steps of:

engaging the top wall (4) of the flat tubular package (3) by suction using a gripping head (10); moving the gripping head (10) to feed the flat tubular package (3) to a seat (11) engaging the bottom wall (5) of the flat tubular package (3) by suction;

producing a relative rotation movement between the seat (11) and the gripping head (10) to convert the tubular package (3) from the flat configuration to an open configuration; and inserting the product (2) inside the open tubular package (3);

wherein the gripping head (10) comprises a first suction portion (13) for engaging the top wall (4), and a second suction portion (14) hinged to the first suction portion (13) and for engaging the lateral wall (6); the gripping head (10) engaging by suction both the top wall (4) and a lateral wall (6) of the flat tubular package (3); the second suction portion (14) being kept parallel to the first suction portion (13) up to the step of producing a relative rotation movement between the seat (11) and the gripping head (10) to convert the tubular package (3) from the flat configuration to the open configuration; and the second suction portion (14) being rotated with respect to the first suction portion (13) to accompany the movement of the lateral wall (6) during the step of producing a relative rotation movement between the seat (11) and the gripping head (10) to convert the tubular package (3) from the flat configuration to the open configuration.

31. A method of packing a product using a flat tubular package, which comprises a top wall (4), a bottom wall (5), and two lateral walls (6), each connected on one side to the top wall (4) and on the other side to the bottom wall (5); the method comprising the steps of:

engaging the top wall (4) of the flat tubular package (3) by suction using a gripping head (10); moving the gripping head (10) to feed the flat tubular package (3) to a seat (11) engaging the bottom wall (5) of the flat tubular package (3) by suction;

producing a relative rotation movement between the seat (11) and the gripping head (10) to convert the tubular package (3) from the flat configuration to an open configuration; and inserting the product (2) inside the open tubular package (3);

wherein the method is performed in a packing machine comprising:

the suction gripping head (10) for engaging the top wall (4) of the flat tubular package (3);

the suction seat (11) for engaging the bottom wall (5) of the fiat tubular package (3);

a feed device (12) supporting the gripping head (10), for moving the gripping head (10) to feed the flat tubular package (3) to the suction seat (11), and for producing the relative rotation movement between the suction seat (11) and the gripping head (10) to convert the tubular package (3) from the fiat configuration to the open configuration;

an insertion device (30) for inserting the product (2) inside the open tubular package (3); and a closing station (28);

wherein the method comprises the further step of moving the suction seat (11) by a conveyor (26) to feed the tubular package (3) to the closing station (28) following insertion of the product (2) inside the open tubular package (3).

32. A method as claimed in claim 31, further comprising transferring the open tubular package (3) containing the product (2) from the suction seat (11) to the closing station (28).

33. A method as claimed in claim 31, wherein the suction seat (11) runs along a fixed guide of the conveyor (26) the method comprising the step of moving the suction seat (11) along the fixed guide by a reversible motor.

34. A method of packing a product using a fiat tubular package, which comprises a top wall (4), a bottom wall (5), and two lateral walls (6), each connected on one side to the top wall (4) and on the other side to the bottom wall (5); the method comprising the steps of:

engaging the top wall (4) of the flat tubular package (3) by suction using a gripping head (10); moving the gripping head (10) to feed the flat tubular package (3) to a seat (11) engaging the bottom wall (5) of the flat tubular package (3) by suction;

producing a relative rotation movement between the seat (11) and the gripping head (10) to convert the tubular package (3) from the flat configuration to an open configuration; and inserting the product (2) inside the open tubular package (3);

wherein the method is performed in a packing machine comprising:

the suction gripping head (10) for engaging the top wall (4) of the flat tubular package (3);

the suction seat (11) for engaging the bottom wall (5) of the flat tubular package (3);

a feed device (12) supporting the gripping head (10), for moving the gripping head (10) to feed the flat tubular package (3) to the suction seat (11), and for producing the relative rotation movement between the suction seat (11) and the gripping head (10) to convert the tubular package (3) from the flat configuration to the open configuration;

an insertion device (30) for inserting the product (2) inside the open tubular package (3); and an input station (7) housing at least one stack (9) in said input station;

wherein the method comprises the step of:

gradually engaging the tubular packages by the gripping head (10); determining the exact position of the flat tubular package (3) on top of the stack (9), before the flat tubular package (3) is engaged; and controlling the feed device (12) supporting the gripping head (10), so as to adapt the position of the gripping head (10) as a function of the exact position determined of the flat tubular package (3), and engage the flat tubular package (3) in accordance with a predetermined mutual arrangement.

35. A method as claimed in claim 34, comprising moving the gripping head (10) with four degrees of freedom comprising three translations in three directions perpendicular to one another, and one rotation about an axis (15) perpendicular to the plane of the flat tubular package (3).

36. A method as claimed in claim 34, wherein the plane of the flat tubular package (3) is a substantially horizontal plane; the feed device (12) having a base (16) supporting a powered articulated arm comprising two members hinged to each other; a first member (18) being hinged at one end to the base (16) for rotating with respect to the base (16) about a horizontal first axis (20), and being hinged at the opposite end to the second member (19) for rotating with respect to the second member (19) about a horizontal second axis (21); the second member (19) being hinged at one end to the first member (18) for rotating with respect to the first member (18) about the horizontal second axis (21), and being hinged at the opposite end to the gripping head (10) for rotating with respect to the gripping head (10) about a horizontal third axis (23).

37. A method as claimed in claim 34, comprising interposing a powered articulated joint (22) between the second member (19) and hinging the gripping head (10), on one side, to the second member (19), and, on the opposite side, to the gripping head (10) to rotate the gripping head (10) about a vertical axis (15).

38. A method as claimed in claim 34, comprising mounting the base (16) of the feed device (12) to run, by virtue of a respective motor, along a horizontal guide (24) parallel to the horizontal first, second and third axes (20, 21, 23).

* * * * *